United States Patent [19]

Raine et al.

[11] 4,165,398

[45] Aug. 21, 1979

[54] PRESSURE-SENSITIVE COPYING PAPER

[75] Inventors: Paul R. Raine, Cardiff; Lawrence Westcott, Bridgend, both of Wales

[73] Assignee: Wiggins Teape Limited, Hampshire, England

[21] Appl. No.: 758,857

[22] Filed: Jan. 12, 1977

[30] Foreign Application Priority Data

Jan. 19, 1976 [GB] United Kingdom ..... 2031/76

[51] Int. Cl.[2] ..... B41M 5/16

[52] U.S. Cl. ..... 427/150; 282/27.5; 427/151; 427/261; 428/307; 428/323; 428/327; 428/341; 428/914

[58] Field of Search ..... 427/146, 150, 261, 151; 282/27.5; 252/316; 428/914, 307, 323, 327, 341

[56] References Cited

U.S. PATENT DOCUMENTS

| | | | |
|---|---|---|---|
| Re. 28,779 | 4/1976 | Katayama et al. | 427/151 X |
| 2,730,457 | 1/1956 | Green et al. | 427/150 X |
| 2,929,736 | 3/1960 | Miller et al. | 428/307 |
| 3,554,781 | 1/1971 | Matsukawa | 428/307 |
| 3,576,660 | 4/1971 | Bayless et al. | 282/27.5 X |
| 3,906,123 | 9/1975 | Vincent et al. | 427/150 X |
| 3,956,172 | 5/1976 | Saeki et al. | 252/316 |
| 3,996,156 | 12/1976 | Matsukawa et al. | 252/316 |
| 4,000,087 | 12/1976 | Maalouf | 252/316 |
| 4,001,140 | 1/1977 | Foris et al. | 427/151 X |
| 4,010,292 | 3/1977 | Shackle et al. | 427/150 |
| 4,012,554 | 3/1977 | Miller et al. | 427/150 X |
| 4,038,445 | 7/1977 | Robertson | 427/150 |

FOREIGN PATENT DOCUMENTS

| | | |
|---|---|---|
| 1436798 | 5/1976 | United Kingdom . |
| 1441230 | 6/1976 | United Kingdom . |
| 1444962 | 8/1976 | United Kingdom . |

*Primary Examiner*—Thomas J. Herbert, Jr.

*Attorney, Agent, or Firm*—Burns, Doane, Swecker & Mathis

[57] ABSTRACT

A method of producing self-contained pressure-sensitive copying material having a coating which contains both a particulate mineral color-developing material and microcapsules enclosing a solution of a colorless color former which is reactive with the color developing material to produce a colored product, in which the particles of color developing material (e.g. an acidic clay) and optionally the microcapsules as well, are treated with a protective agent to inhibit premature color development. The protective agent may be a self-crosslinkable polymer, such as an aminoplast polymer (e.g. a urea-formaldehyde or melamine-formaldehyde polymer), or a epichlorohydrin polymer (e.g. an aminoepichlorohydrin or an amide/aminoepichlorohydrin polymer), or an anionic surfactant (e.g. a lauryl sulphate salt or a sulphonated ricinoleic acid derivative, a dodecyl benzene sulphonate salt, or a dibutyl or dioctyl ester of sulphosuccinic acid), or a fluorine-containing paper sizing agent, or a non-self-crosslinkable polymer which is a wet-strength agent for paper (e.g. a polyethylene imine resin).

27 Claims, 2 Drawing Figures

PRESSURE-SENSITIVE COPYING PAPER

Figure 1:
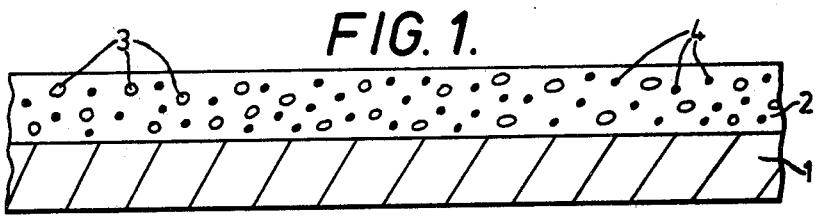

This invention relates to pressure-sensitive copying material, e.g. pressure-sensitive copying paper.

In a widely used pressure-sensitive copying system, usually known as a transfer system, an upper sheet is coated on its lower surface with microcapsules containing a solution of colourless colour former, and a lower sheet is coated on its upper surface with colour developing material, for example an acidic clay or a phenolic resin. For most applications, a number of intermediate sheets are also provided, each of which is coated on its lower surface with microcapsules and on its upper surface with colour developing material. Pressure exerted on the sheets by writing or typing ruptures the microcapsules, thereby releasing the colour former solution on to the colour developing material on the next lower sheet and giving rise to a chemical reaction which develops the colour of the colour former.

Such a system has the disadvantage that it is necessary to produce at least two, and usually three, types of coated sheet, i.e. the upper, lower and intermediate sheets referred to above.

In order to overcome the disadvantages just mentioned, the use of a so-called self-contained system has been proposed. In this system, microcapsules and colour developing material are coated onto the same surface of a sheet, and writing or typing on another sheet placed above the thus coated sheet causes the capsules to rupture and release the colour former which then reacts with the colour developing material on the sheet to produce a colour.

A disadvantage of the self-contained system is that it has hitherto been necessary to manufacture the sheet by a two-stage coating operation. The first stage involves the application of a microcapsule-containing composition to the sheet, and the second stage the application of a coating of a colour developing material to the coated sheet produced in the first stage.

It would clearly be simpler, and hence cheaper, to apply the microcapsules and the colour developing material simultaneously in a single coating operation. Proposals for this have been made, e.g. in U.S. Pat. No. 2,730,457. However, our experience has been that premature colour development occurs if this is done either on mixing a suspension of microcapsules with a dispersion of colour developing material prior to the coating operation or after coating has been carried out.

The reasons for premature colour development are complex and are not fully understood. One reason for the premature colour development is thought to be that microcapsule suspensions as manufactured generally contain a certain amount of unencapsulated colour former solution, which reacts rapidly with the colour developer in the system to produce a colour. However, it has been found that premature colour development may still occur even if unencapsulated colour former solution is not present, for example if it is removed before admixture with the colour developer material, which anyway on a production scale would probably be prohibitively expensive. The reason for premature colour development arising in this way is not fully understood, but our investigations have suggested that it may be due to mutual attraction between the capsules and the particles of colour developing material. Exactly how such attraction causes premature blueing is not known.

As mentioned above, it has also been found that even if an uncoloured coating composition can be obtained, paper coated with the composition may become coloured, either immediately on drying or during the few days after coating. Again the reason for the premature colour development is not fully understood.

It has now been found that in the case of a particulate mineral colour developing material, the above described premature colour development effects can be substantially avoided or at least reduced by suitably chemically treating the colour developing material, and optionally the microcapsules as well. The material used for such treatment will hereafter be referred to as a protective agent.

According to a first aspect of the invention, there is provided a method of producing pressure-sensitive copying material comprising the step of coating sheet material with a coating composition which contains both a particulate mineral colour developing material and microcapsules enclosing a solution of a colourless colour former which is reactive with the colour developing material to produce a coloured product, the colour developing material, and optionally the microcapsules as well, having been treated with a protective agent in an amount which is effective to inhibit premature colour development, is compatible with the microcapsules, and does not substantially mask the colour developing properties of the colour developing material.

According to a second aspect of the invention, there is provided pressure-sensitive copying material comprising a sheet material on which is a layer of a coating composition which contains both a particulate mineral colour developing material and microcapsules enclosing a solution of a colourless colour former which is reactive with the colour developing material to produce a coloured product, the coating composition also containing a protective agent in an amount which is effective to inhibit premature colour development, is compatible with the microcapsules, and does not substantially mask the colour developing properties of the colour developing material.

Certain materials which are usable with some types of microcapsules are found to leach out the contents of other types of microcapsules. It is therefore important to ensure that the protective agent is compatible with the type of microcapsules being used. Examples of incompatible combinations of protective agent and microcapsules are given hereafter.

The particulate mineral colour developing material is preferably an acidic clay, e.g. as found in Japan and sometimes known as Japanese acid clay.

The particulate mineral colour developing material may be treated with protective agent by simply mixing a suspension of the material with the protective agent. The mixture may then be allowed to stand, optionally with stirring.

The protective agent may be a self-crosslinkable polymer in which case it may be desirable to heat the mixture of polymer and colour developing material before mixing with the microcapsules.

It is preferable to treat the colour developing material, and the microcapsules if desired, before mixing the colour developing material and the microcapsules. However, in cases where premature colour development does not occur immediately on mixing, it may be possible to add the protective agent after mixing, whilst still achieving the desired result.

The expression "crosslinkable polymer" where used in this specification comprehends not only polymers having a large number of repeating units, but also so-called prepolymers or pre-condensates, which have only a small number of repeating units.

The self-crosslinkable polymer may be a resin or precondensate as used in the paper industry for imparting wet strength to a paper web. Epichlorohydrin and aminoplast resins or precondensates are preferred. Examples of suitable epichlorohydrins are "Nadavin" FP and "Nadavin" FPN, both of which are polyaminoepichlorohydrin resins, and "Nadavin" LT, which is a polyamide/polyaminoepichlorohydrin resin, all of which are supplied by Bayer U.K. Ltd. "Nadavin" FP is preferred. Examples of suitable aminoplasts are melamine formaldehyde resins or precondensates or urea formaldehyde resins or precondensates. Of the aminoplasts, melamine formaldehyde materials have generally been found to be the more effective in preventing premature colour development. An example of a suitable melamine formaldehyde resin is Beetle Resin BC 27 sold by British Industrial Plastics Limited. BC 27 as supplied has a reactive resin content of about 100% and a solids content of about 93%. Examples of suitable melamine formaldehyde precondensates are Beetle Resins BC 71, BC 309 and BC 336, all of which are also sold by British Industrial Plastics Limited, and are methylated modified melamine formaldehyde precondensates. BC 71 as supplied has a reactive resin content of about 80% and a solids content of about 69%. BC 309 as supplied has a reactive resin content of about 90% and a solids content of about 80%. BC 336 as supplied has a reactive resin content of about 76% and a solids content of about 71%.

Other aminoplasts which may be used are L 5084 urea formaldehyde and BC 6 urea formaldehyde precondensates, both also sold by British Industrial Plastics Limited. As supplied, the former has a reactive resin content of about 70%, and a solids content of about 68%, and the latter a reactive resin content of about 50% and a solids content of about 45%. Other self-crosslinkable polymers which may be used as protective agents are those sold as Kymene 709 and Kymene 557 by Hercules Powder Company, and that sold as Nopcobond SWS-10 by Diamond Shamrock Corporation.

When the protective agent is a self-crosslinkable polymer, the mode of treatment of colour developing material depends largely on the nature of the polymer. Choice of suitable treatment conditions is well within the capability of a technologist experienced in this field. In the case of acidic clay colour developing material and the BC 27 and BC 71 melamine formaldehyde materials referred to above, a suitable treatment is to heat the clay slurry with a 10% resin or precondensate solution (based on weight of resin to weight of dry acidic clay) for about two hours at 90° C. In the case of polyaminoepichlorohydrin resins and acidic clay colour developing material, a suitable treatment is to mix the clay with a 10% aqueous resin solution and to stir for a few minutes at pH 7 or 8. Heating is unnecessary.

The capsules may with advantage in some cases also be treated with self cross-linkable polymer, conveniently with the same crosslinkable polymer, as is used for treating the colour developing material.

Wet strength agents for paper which are not self-crosslinkable polymers may also be used as protective agents, for example polyethylene imine resins such as that sold as Polymin P by BASF.

Other materials which can be used as protective agents are anionic surfactants, particularly those containing sulphate or sulphonate groups. An example of an anionic surfactant containing a sulphate group is a lauryl sulphate salt such as sodium lauryl sulphate. Sulphonate containing surfactants include dodecylbenzene sulphonic-acid salts, the dibutyl ester of sulphosuccinic acid (e.g. that sold as Manoxol 1B by BDH Chemicals Limited); the dioctyl ester of sulphosuccinic acid (e.g. that sold as Manoxol OT by BDH Chemicals Limited or that sold as Triton GR5 by Rohm & Haas), and sulphonated ricinoleic acid derivatives (e.g. that sold as Glanzol CFD or Glanzol 100 by Zschimmer and Schwarz of Lahnstein, Federal Republic of Germany). Glanzol CFD is in fact offered for sale primarily as a plasticizer for coating compositions, but it is also a surfactant. An example of an anionic surfactant which is usable as a protective agent but does not contain sulphate or sulphonate groups is ethylene diamine tetra acetic acid (EDTA).

Plasticizers other than Glanzol CFD which are anionic surfactants are also effective as protective agents, e.g. di-butyl phthalate, di-2-ethyl hexyl adipate, di-butyl maleate and Tris(Livenol 7-9)trimellitate. However, these possess the disadvantages that they result in oily spots on the coated sheet, and hence are not favoured.

Another class of materials which can be used as protective agents are fluorine-containing sizing agents for paper, which are intended to impart hydrophobicity. Examples of such materials are Zonyl RP or Zonyl NF sold by Du Pont, and Scotchban FC 807 sold by 3M.

Mixtures of different protective agents may be used if desired. In some cases, the use of a mixture affords advantages over the use of the components of the mixture alone. Mixtures of fluorine-containing sizing agents and the Kymene resins mentioned earlier have been found to possess better protective properties than the sizing agents or the Kymene resins alone.

The quantity of protective agent to be used depends on the capsules and colour developing material being used. The optimum quantity can be established without difficulty by the expert. Guidance is obtainable from the quantities given in the Examples given hereafter.

Conventionally, microcapsules for use in a self-contained pressure-sensitive copying system have had to be thicker walled, i.e. stronger, than those used in the more widely used transfer system described above. Similarly, in the present system, which is of course a self-contained system, the capsules should likewise be stronger than those normally used in a transfer pressure-sensitive system if an acceptable product is to be obtained. The production of strong capsules for use in self-contained pressure-sensitive copying paper is well known in the art, but will in any case be exemplified hereafter.

Although it is preferable to use stronger capsules than those normally used in a transfer pressure-sensitive copying system, a slight reduction in premature colour development may nevertheless be observed with transfer-type capsules if the particulate colour developing material is treated with self-crosslinkable polymer before being mixed with a microcapsule suspension to produce the coating composition. The resulting product is however likely to be too coloured for use.

The capsules for use in the present invention may have synthetic walls, for example of melamine formaldehyde resin urea formaldehyde resin and an acrylamide/acrylic acid copolymer as disclosed in our co-pending British patent application No. 48616/75, or of urea formaldehyde polymer as disclosed in German Offenlegungsschrift No. 2 529 427. Other synthetic materials which may be used include polyacrylates, polyurethanes, polyureas or aminoplasts other than those quoted previously. Alternatively, the capsules may have walls of coacervated hydrophilic colloids, for example a mixture of gelatin, gum arabic or carboxymethyl cellulose (CMC), and polyvinyl methyl ether/-maleic anhydride copolymer (PVM/MA) as disclosed in British Pat. No. 870 476. In order that such capsules should be sufficiently strong for use in self-contained paper, the phase ratio at which they are produced should preferably be lower than that for capsules intended for use in a transfer type of pressure-sensitive copying system (the phase ratio is the weight ratio of colour former solution to capsule wall material in the aqueous solution from which the capsules are formed). The use of a lower phase ratio results in thicker walled capsules than if a high phase ratio is used. If transfer-type capsules are used, the use of the present invention results in less blueing than if no protective agent is present, but the degree of blueing is likely to be too great to be acceptable.

Capsules having synthetic walls, e.g. of aminoplast materials tend to be stronger and less permeable than those of the gelatin coacervate type. Hence there is a tendency for premature blueing to occur less with synthetic capsules than with the gelatin coacervate type of capsule. However, it has so far been found desirable to protect synthetic-walled capsules, even though the difference in whiteness between protected and non-protected copying paper may be small. Small differences in whiteness are noticeable to the eye, and as a result can greatly affect the commercial acceptability of the paper.

Not all the protective agents quoted earlier are usable with all types of capsule. The anionic surfactants for example leach out the contents of capsules having walls of gelatin coacervate-type capsules, but they are usable with aminoplast synthetic-walled capsules. The expert will have no difficulty in choosing a protective agent which is compatible with the capsules he wishes to use.

Some materials which might be thought suitable for use as protective agents are in fact unsuitable. Cationic and non-ionic surfactants, which might be expected to have the same effect as anionic surfactants, have so far been found in practice to "poison" the colour developing material, i.e. to prevent its functioning satisfactorily as a colour developer. Retention aids for use in paper-making, which in some respects are chemically similar to wet-strength agents might be thought to work, but in practice have so far been found to cause flocculation of the coating composition. There are possibly ways in which the above problems could be overcome.

The invention is not limited to the use of particular colour formers or particular solvents for the colour formers. Examples of colour formers which may be used are phthalide derivatives such as crystal violet lactone; fluoran derivatives; diphenylamine derivatives; spiropyrane derivatives; phthalimidine derivatives; and benzoyl leuco derivatives of various dyes. As is well known in the art, mixtures of colour formers may be used. Examples of solvents which may be used are mixtures of partially hydrogenated terphenyls; chlorinated paraffins; biphenyl derivatives, diaryl methane derivatives, alkyl naphthalenes, mixtures of dibenzyl benzenes; phthalate or phosphate esters or linear alkyl benzenes having 10 to 14 carbon atoms. The solvents may be used in admixture with diluents such as kerosene.

If it is desired to treat the capsules with protective agent as well as the colour developing material, the conditions of capsule treatment depend on the precise materials used. The choice of conditions is within the capability of an experienced technologist. Guidance is given in some of the Examples hereafter.

The coating composition may also contain a filler for improving the rheology of the coating composition and for increasing the whiteness of the coated sheet. Suitable fillers include china clay and calcium carbonate. Such fillers sometimes have a very slight colour developing effect, as is well known. That effect may not be sufficiently serious to warrant attention but if desired, the filler may be treated with protective agent in a similar manner to that in which the colour developing material proper is treated. The conditions for treating china clay for example would be much the same as those for treating acidic colour developing clay.

Care must be exercised in choosing a suitable binder for the coating composition. Certain binders which are conventionally used in pressure-sensitive copying paper of the transfer type may have a colour developing effect, or have other undesirable properties, and are therefore not suitable for use. For example, a starch binder may diminish the reactivity of the colour developing material, possibly because it forms a film over the surface of the particles of colour developer. The applicants have found a highly hydrolysed polyvinyl alcohol to be particularly suitable for use as a binder in the present coating composition.

The coating composition may also contain a dispersant, preferably a dispersant which also serves to control the pH of the coating composition. Such dispersants are well known for use in colour developing compositions for use in pressure-sensitive copying paper, and examples of them are sodium silicate and sodium hydroxide, both of which also serve for pH control. The optimum pH is preferably chosen to be that most conducive for the colour development reaction. For example, if crystal violet lactone is one of the colour formers, and acidic clay is the colour developing material, a suitable pH for the coating composition is about 10.0.

The coating composition may also contain an agent for protecting the capsules from premature rupture during storage and handling of the coated web. The use of such a protecting agent (often known as a stilt material) is well known in the pressure-sensitive copying paper art and so will not be described further herein. Two examples of suitable stilt materials are cellulose fibre floc and wheatstarch granules.

A typical dry coat weight for the present coated paper is from 10 to 15 g/m$^2$.

The coating techniques used in the production of the present paper may be conventional coating techniques such as blade coating, air knife coating or roll coating. It has hitherto not been conventional for capsule-containing compositions to be blade coated on a commercial scale, since an economically low coatweight could not be applied sufficiently evenly. The present invention facilitates blade coating, since the colour developing material present in the composition with the microcapsules means that the coatweight to be applied is higher than is the case with microcapsules alone. The possibility of blade coating affords considerable advantages in speed of operation and in potential tonnage of copying paper which can be produced at a coating mill.

The mechanism by which the protective agent prevents premature colour development in a coating composition for a self-contained paper is not fully understood. It is thought that the action of the protective agent is to reduce mutual attraction of the colour developing material and the capsules, but in this respect we do not wish to be bound by any particular theory of operation.

Figure 2:
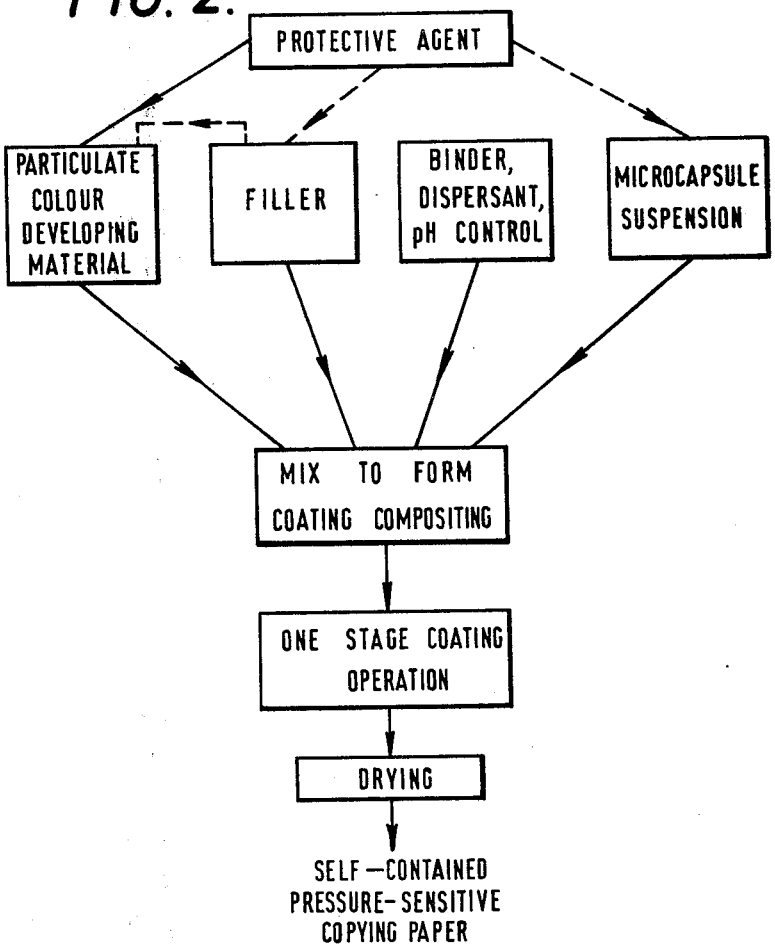

In order to enable the invention to be more readily understood, reference will now be made to the accompanying drawings of which FIG. 1 is a diagrammatic section on an enlarged scale through a sheet of the present pressure-sensitive copying paper, and FIG. 2 is a flow diagram illustrating an exemplary method for production of the paper shown in FIG. 1.

Referring first to FIG. 1, a sheet of self-contained pressure-sensitive copying paper comprises a paper base 1 carrying a coating 2 containing microcapsules 3 and particles 4 of colour developing material. The remaining constituents of the coating are not shown, for the sake of clarity. One such constituent is the protective agent, but it is not known precisely where it is located.

Referring now to FIG. 2, particulate colour developer, microcapsule suspension, filler, binder dispersant and pH controlling agent are mixed to form a coating composition. Before mixing, the colour developer, and optionally the microcapsules and/or the filler, are treated with protective agent. If desired, the filler may be mixed with the colour developer before treatment with protective agent. In FIG. 2 optional alternatives are shown by broken lines. The mixture is then coated on to a paper substrate and dried, to give a paper sheet as shown in FIG. 1.

The invention will now be illustrated by the following Examples:

EXAMPLE I

(a) Capsule Preparation 382 g of 9.1% gleatin solution at pH 6.4 were placed in a Waring Blender. With the Blender running at low speed, 274 g of internal phase, i.e. material to be encapsulated, were added. The internal phase was a 9:1 mixture of Dobane JN (a mixture of linear alkyl benzenes having from 10 to 14 carbon atoms per molecule, sold by Shell) and Santicizer 711 (a phthalate material sold by Monsanto) containing 1.8% (w/w) crystal violet lactone and 1.4% (w/w) benzoyl leuco methylene blue. The Blender was run until the droplet size was below 3 μm.

58 gms of an 17.6% (w/w) aqueous solution of gum arabic and 422 gms of de-ionised water were added to 218 gms of the gelatine solution/internal phase emulsion. The pH was adjusted to 8.7 with NaOH and 8 gms of 5% (w/w) aqueous solution of polyvinyl methyl ether/maleic anhydride (PVM/MA) were added slowly. 14.7% acetic acid was then used to reduce the pH evenly to 4.3, during which time coacervate separated out and wrapped around the droplets of internal phase. The emulsion was then chilled to 10° C., and 3.3 ml of 50% glutaraldehyde were used to cross-link the coacervate.

A further 10 gms of PVM/MA were added to prevent agglomeration of the capsules. 6.0 gms of 12.5% (w/w) aqueous solution of sodium carbonate solution were added as a pH buffer. The pH was then raised very slowly with sodium hydroxide to 10.0.

(b) Coating Composition Preparation & Application 30 g acidic colour developing clay (Silton M-AB supplied by Mizusawa of Japan) were then dispersed in water to give an approximately 36% solids content mix. 3 g BC 71 melamine formaldehyde precondensate were added as protective agent. The resulting slurry was heated with stirring to 90° C., maintained at this temperature for 2 hours, and then cooled.

10 g Dinkie 'A' clay were then dispersed in sufficient water to give an approximately 36% solids content mix. 1 g BC 71 melamine formaldehyde precondensate was added as protective agent and the slurry was heated to 90° C., maintained at this temperature for 2 hours, and then cooled.

The thus treated Silton and Dinkie clays were mixed and the pH of the mixture was adjusted to 10 with NaOH solution.

132 ml of a capsule suspension prepared as described above were then added to the clay slurry followed by 30 g 10% PVOH binder (MOVIOL 56–98 supplied by Harlow Chemical Co. Ltd.). The resulting mixture was then coated at 9 g/m$^2$ onto a 49 g/m$^2$ base paper by means of a laboratory coater, and after drying, the paper was treated for whiteness using an opacimeter (e.g. a Bausch and Lomb opacimeter as described in U.S. Pat. No. 1,950,975 or a Diano BNL2 opacimeter). The test involves measurement of the reflectance of the sheet and comparison of the result obtained with the reflectance of a standard white surface (a magnesium oxide powder coated surface). The result is expressed as a percentage equal to (reflectance of sheet) $\times 100$ divided by (reflectance of standard white surface). Thus the higher the figure obtained, the whiter the background. The test is carried out at a number of different locations on the paper, and the results are then averaged. A difference of only a few % may at first sight seem insignificant, but such a difference is readily apparent to the eye, and can greatly affect the commercial acceptibility of the paper.

A mean result of 93% was obtained and the sheet appeared white. When an ordinary sheet of paper was placed over the thus coated sheet and written upon, a distinct blue image was produced on the coated sheet.

In order to demonstrate the effect of the melamine formaldehyde precondensate, a similar experiment was carried out in which neither the Silton nor the Dinkie clay was pretreated with melamine formaldehyde precondensate.

30 g Silton M-AB clay and 10 g Dinkie 'A' clay were dispersed in sufficient water to give an approximately 40% solids content mix. The pH of the mix was adjusted to 10 with sodium hydroxide solution.

132 ml of a capsule suspension prepared as described above were added, together with 30 g 10% PVOH binder ("Gohsenol NH 26" supplied by Nippon Synthetic Chemical Industry Co. Ltd. of Japan).

The resulting mixture was pale blue, and when coated onto paper at a coatweight of 9 g/m$^2$, the sheet was pale blue, with a mean background reflectance of 81%.

EXAMPLE II

This illustrates the use of a different self-crosslinkable polymer as a protective agent.

3 g Nadavin FP was dissolved in 60 g water for use as the protective agent. 30 g of Silton M-AB acidic colour developing clay and 10 g Dinkie 'A' clay were dispersed in this solution. 2 g of 1% Dispex N40 solution (a dispersant supplied by Allied Colloids Ltd. as a 1% solution) were added to prevent flocculation. The pH was adjusted slowly to 10 with sodium hydroxide solution.

132 ml of capsule suspension prepared as described in Example I were added, followed by 30 g 10% PVOH binder (MOVIOL 56–98).

The resulting mix colour was very pale blue, and when paper was coated at a coatweight of 8 g/m$^2$, a pale blue sheet was obtained, having a mean background reflectance of 87%. This is an improvement over untreated Silton, which as stated in Example I gave a background reflectance of 81%. On repeating the procedure using a different colour former solution the treated Silton sheet had a mean background reflectance of 88%.

When an ordinary sheet of paper was placed over the coated sheets produced using the treating procedures described above and written upon with ordinary writing pressure a distinct blue image was produced on both coated sheets.

EXAMPLE III

(a) Capsule Preparation

The following were first mixed:

(i) 19 g of BC 77 cationic urea-formaldehyde resin having a reactive resin content of approximately 45% and a solids content of approximately 35% (BC 77 is supplied by British Industrial Plastics Limited);

(ii) 42 g of R1144 (a 20% solution of an acrylamide/acrylic acid copolymer, supplied by Allied Colloids Limited, and having a viscosity average molecular weight of 40,000 and an acrylic acid content of 42%).

(iii) 200 g de-ionized water.

The mixture was then heated to 55° C. and maintained at that temperature for 45 minutes. 12 g of BC 336 melamine formaldehyde precondensate were then added, and the pH was then lowered to 4.4 with acetic acid.

89 g of colour former solution were then added and the dispersion thus formed was milled to a droplet size of 4 to 5 μm, 20 g de-ionized water were then added. The mixture was then stirred for one hour at 35° C., and then for a further two hours at 55° C., after which the mixture was allowed to cool to ambient temperature overnight. Next morning the pH was raised to 10.0 with 10% sodium hydroxide solution. The solids content of the resulting capsule suspension was approximately 30%, and the phase ratio was 3.4:1.

(b) Coating Composition Preparation and Application 15 g Silton M-AB acidic colour developing clay were dispersed in sufficient water to make an approximately 40% solids content mix, and 1.5 g of BC 71 melamine formaldehyde precondensate were then added as protective agent. The mixture was then heated to 90° C., maintained at that temperature for 2 hours, and allowed to cool. The pH was then adjusted to pH 10 with sodium silicate.

20 mls of the capsule suspension (capsule dry weight 5.5 g) were then mixed with 0.55 g BC 71 melamine formaldehyde resin as protective agent and the mixture was heated to 70° C., maintained at that temperature for 1 hour, and allowed to cool.

The treated colour developing clay dispersion and the treated capsule suspension were then mixed, and 15 ml of 10% polyvinyl alcohol ("Gohsenol NH 26") were added with stirring, followed by 15 g of china clay (Dinkie 'A'), also with stirring.

The resulting mixture was then coated onto a paper sheet as described in Examples I and II, except that the coatweight was 12.5 g/m$^2$. The sheet was tested for whiteness and a mean result of 93.5% was obtained. When an ordinary sheet of paper was placed over the thus coated sheet and written upon with ordinary writing pressure, a distinct blue image was produced on the coated sheet.

After 10 days, the sheet whiteness measurement was repeated and a mean figure of 88% was obtained.

EXAMPLE IV

(a) Capsule Preparation

This was as described in Example III, except that after the colour former solution had been added and milled, 40 g de-ionized water and 10 g of BC 336 were added. The remaining stages were then as described in Example III.

(b) Coating Composition Preparation & Application 20 g Silton M-AB acidic colour developing clay were dispersed in sufficient water to make an approximately 40% solids content mix, and 2.0 g of BC 71 melamine formaldehyde precondensate were then added as protective agent. The mixture was then heated to 90° C., maintained at that temperature for 2 hours, and allowed to cool. The pH was then adjusted to pH 10 with sodium silicate.

15 g of china clay (Dinkie 'A') were dispersed in sufficient water to make an approximately 50% solids content mix, and 1.5 g of BC 71 melamine formaldehyde precondensate were then added as protective agent. The mixture was then heated to 90° C., maintained at that temperature for 2 hours, and allowed to cool.

The treated colour developing clay dispersion and the treated china clay dispersion were then mixed.

25 mls of capsule suspension (capsule dry weight 5.8 g) were then mixed with 0.58 g BC 71 melamine formaldehyde precondensate as protective agent and the mixture was heated to 70° C., maintained at that temperature for 1 hour, and allowed to cool. The thus treated capsule suspension was then added to the treated clay dispersion.

15 mls of 10% polyvinyl alcohol ("Gohsenol NH 26") were then added, with stirring.

The resulting composition was then coated onto a paper sheet as described in the previous Examples, except that the coatweight was 14 g/m$^2$. The sheet was tested for whiteness and a mean result of 97% was obtained. When an ordinary sheet of paper was placed over the thus coated sheet and written upon with ordinary writing pressure, a distinct blue image was produced on the coated sheet.

After 10 days, the sheet whiteness measurement was repeated and a mean figure of 96% was obtained.

EXAMPLE V

The capsules used in this Example were as described in Example IV, but they were not treated with melamine formaldehyde.

15 g of Silton M-AB acidic colour developing clay were dispersed in sufficient water to make an approximately 40% solids content mix, and 1.5 g of BC 27 melamine formaldehyde resin were then added as protective agent. The mixture was heated to 90°, maintained at that temperature for 2 hours, and allowed to cool. The pH was then adjusted to 10 with sodium silicate.

25 mls capsule suspension (capsule dry weight 5.8 g) were added, followed by 15 mls 10% polyvinyl alcohol ("Gohsenol NH 26") and 15 g china clay (Dinkie 'A'), both with stirring.

The resulting composition was then coated onto a paper sheet as described in the previous Examples, except that the coatweight was 13.6 g/m$^2$. The sheet was tested for whiteness, and a mean result of 96.5% was obtained. When an ordinary sheet of paper was placed over the thus coated sheet and written upon with ordinary writing pressure, a distinct blue image was produced on the coated sheet.

After 10 days, the sheet whiteness measurement was repeated and a mean figure of 96% was obtained.

EXAMPLE VI

The capsules used in this Example were prepared as described in Example IV but were not subsequently treated with melamine formaldehyde.

30 g of Silton M-AB clay were dispersed in sufficient water to make an approximately 40% solids content mix. The pH was then adjusted to 10 with sodium silicate. The dispersion was then divided into two batches, one of which was then treated with BC 71 melamine formaldehyde precondensate as protective agent as described in Example IV.

22 mls of the capsule suspension (capsule dry weight about 7 g) were added to each batch of clay dispersion, followed by 15 ml 10% PVOH ("Gohsenol NH 26") with stirring. The resulting compositions, which were both colourless, were then coated on to a paper sheet as described in the previous Examples so as to give a coatweight of 8 g/m$^2$. The sheet colour of the treated clay composition was white, and gave a mean background reflectance value of 95% whereas for the untreated clay composition, a mean background reflectance of 91% was obtained.

When ordinary sheets of paper were placed over both the thus coated sheets and written upon with ordinary writing pressure, a distinct blue image was produced on both sheets, but that on the treated clay sheet was more distinct.

After 10 days, the background reflectance measurements were repeated and a mean figure of 85% was obtained for the untreated clay sheet. The figure for the treated clay sheet was 92%.

EXAMPLE VII

This illustrates the use of an aminoepichlorohydrin resin as protective agent instead of a melamine formaldehyde resin or precondensate.

The capsules used in this example were prepared as described in Example IV, but not treated with melamine formaldehyde.

15 g of Silton M-AB acidic colour developing clay were dispersed in sufficient water containing 1.5 g Nadavin FP aminoepichlorohydrin resin as protective agent to give an approximately 30% solids content mix. The pH was adjusted to 8 with sodium hydroxide and the mix was stirred at room temperature for a few minutes. The pH was then adjusted to 10 with sodium hydroxide.

22 mls of capsule suspension (7 g dry weight) were added, followed by 15 ml of 10% polyvinyl alcohol ("Gohsenol NH 26") with stirring. The resulting composition was then coated onto a paper sheet with a coatweight of 8 g/m$^2$. The sheet colour was white and when testing for whiteness, a mean reflectance of 93% was obtained.

When an ordinary sheet of paper was placed over the coated sheet and written upon with ordinary writing pressure a distinct blue image was produced on the coated sheet.

After 10 days, the sheet whiteness measurement was repeated and a mean figure of 92.1% was obtained.

It will be noted that it is unnecessary to heat the Nadavin resin, as was done with the melamine formaldehyde resins discussed previously. Moreover, any possibility of formaldehyde fumes being evolved is minimized.

EXAMPLE VIII

This illustrates the production of the present pressure-sensitive copying paper by a coating operation on a full size coater rather than a laboratory coater.

(a) Capsule Preparation

This was done at 2.7:1 phase ratio as follows:

80.0 kg of hot de-ionized water were mixed with 16.8 kg R1144 acrylamide/acrylic acid copolymer, and the temperature was raised to 55° C. 7.6 kg of BC 77 urea formaldehyde resin were added, and the mixture was stirred for 40 minutes while maintaining a temperature of 55° C. 8.9 kg of BC 336 melamine formaldehyde precondensate were then added, and the pH was adjusted to 4.4 with acetic acid. 36.4 kg of a colour former solution were then added, and the dispersion thus produced was milled to a droplet size of 4 to 5 μm. The pH was then adjusted to 4.0 with acetic acid, and the mixture was heated to 55° C., and maintained at that temperature for 3 hours. The pH was then raised to 10.0 and the mixture was left stirring overnight. The solids content of the resulting capsular emulsion was 29.5%.

(b) Coating Composition Preparation & Application 22 gallons of water were added to a casein pot and 50 kg of Silton M-AB clay were dispersed in this water. 5 kg of BC 71 melamine formaldehyde precondensate were then added as protective agent, and the mixture was maintained at a temperature above 90° C. for 2 hours with stirring. The mix was then transferred to a rod mill and the procedure was repeated with a further 50 kg Silton M-AB clay.

100 kg Dinkie 'A' clay was treated in the same way as described for the Silton M-AB clay, and the resulting mix was also transferred to the rod mill.

13 kg of 50% strength sodium silicate were then added and the resulting clay slurry was transferred to a storage vat.

11 kg PVOH ("Gohsenol NH 26") were added to 30 gallons of water in a casein pot. The water was heated to 90° C. to dissolve the PVOH, and the solution was then transferred to a further rod mill.

32 gallons (47 kg capsule dry weight) of capsule suspension produced as described in (a) above were then added to a casein pot. 4.7 kg BC 71 melamine formaldehyde precondensate as protective agent were added, and mixed in, and the mixture was heated to 70° C. for one hour with stirring. The mixture was then added to the PVOH in the rod mill. After blending, the resulting mixture was added to the clay slurry in the storage vat.

After overnight storage, the mixture was coated onto paper by means of an air-knife coater, at a range of different coatweights. The results are shown in Table VIII below.

TABLE VIII

| Coatweight ($g/m^2$) | 17.0 | 17.0 | 16.7 | 8.3 | 16.7 | 14.0 | 14.7 |
|---|---|---|---|---|---|---|---|
| Mean Background reflectance % | 95.9 | 96.2 | 97.0 | 96.4 | 96.9 | 95.3 | 96.7 |

When an ordinary sheet of paper was placed over the coated sheet and written upon with ordinary writing pressure a distinct blue image was produced on the coated sheet.

After 10 days the sheet whiteness measurement was repeated on the 14.0 $g/m^2$ sample and a mean figure of 94.0% was obtained.

After 14 months the sheet whiteness measurement was repeated on the 14.0 $g/m^2$ sample and a mean figure of 93.4% was obtained.

EXAMPLE IX

This illustrates the production of the present pressure-sensitive copying paper by a coating operation on a full size coater but using a different crosslinkable polymer to that used in the previous Example.

(a) Capsule Preparation

The capsules used in this example were prepared as described in Example VIII.

(b) Coating Composition Preparation & Application 10 kg of Nadavin FP as protective agent and 50 g Dispex N40 were dissolved in 46 gallons water in a rod mill. 75 kg Silton M-AB clay and 25 kg Dinkie 'A' clay were dispersed in this water. The pH was adjusted slowly to 10 with 14% sodium hydroxide solution.

Approximately 178 kg (55 kg capsule dry weight) of capsule suspension produced as described in (a) above were added to the clay slurry. 30 kg Dow 620 latex binder (15 kg dry weight) were then added and after blending the mixture was transferred to a storage vat.

The mixture was coated on to paper by means of an air knife coater, and the results are shown in Table IX below:

TABLE IX

| Coatweight ($g/m^2$) | 5 | 4 | 6 |
|---|---|---|---|
| Mean Background reflectance % | 96 | 96 | 97 |

When an ordinary sheet of paper was placed over the coated sheet and written upon with ordinary writing pressure a distinct blue image was produced on the coated sheet.

After 12 days the sheet whiteness measurement was repeated on the 6 $g/m^2$ sheet and a mean figure of 96% was obtained.

After 10 weeks the sheet whiteness measurement was repeated on the 6 $g/m^2$ sheet and a mean figure of 96% was obtained.

EXAMPLE X 10 g of Silton M-AB clay and 3 g of Dinkie 'A' china clay were dispersed in 20 ml water and protective agent was added. The pH was adjusted slowly to 10 with sodium hydroxide solution. 38 ml of a 17.5% solids content microcapsule suspension (prepared generally as described in Example I), were then added. 10 g of 10% PVOH binder (MOVIOL 56-98) were also added. The resulting mixture was then coated at a coatweight of about 10 $g/m^2$ on to a 49 $g/m^2$ base paper. After drying, the background reflectance was measured at various parts of the sheet by means of an opacimeter as described previously and a mean value obtained. The results, together with that of a control experiment in which no protective agent was used are shown in Table X below:

TABLE X

| Protective Agent & Quantity used (based on wt. of clay) | Background Reflectance (%) Initial | After 10 days |
|---|---|---|
| None (control) | 84.5 | 81.8 |
| Nadavin FP (10%) | 87.8 | 85.1 |
| Polyamin p (10%) | 91.3 | 90.7 |
| Zonyl RP (10%) | 91.2 | 89.7 |
| Manoxol IB (10%) | 89.4 | 83.5 |
| Kymene 709 (5%)+ + Zonyl RP (0.5%) | 88.8 | 84.2 |

Each of the protective-treated coated sheets was placed beneath an ordinary sheet of paper which was then written upon. A distinct blue image was produced on the coated sheet in every case.

EXAMPLE XI

(a) Capsule Preparation 42 g of R1144 copolymer was added to 170 g de-ionized water and the mixture was heated to 55° C. 19 g of BC 77 resin was added, and the mixture was maintained at 55° C. for 40 minutes. 105 g deionized water were then added, followed by 179 g of colour former solution. The resulting dispersion was milled to a droplet size of 4–5 μm, and then chilled to 15° C. 40 g of BC 336 precondensate and 125 g de-ionized water were then added, and the pH of the dispersion was adjusted to 4.15 with acetic acid. The temperature was maintained at 15° C. for one hour, and then raised to 55° C. and maintained at that temperature for a further two hours. Finally the pH was raised to 8.5 with sodium hydroxide solution.

(b) Coating Composition Preparation and Application 22.5 g of Silton M-AB clay and 7.5 g of Dinkie 'A' china clay were dispersed in 40 ml water, and protective agent was added. The pH was adjusted slowly to 10 with sodium hydroxide solution. 65 ml of an approximately 30% solids content microcapsule suspension (prepared as described above were added). 22.5 g of a wheatstarch granules (Keestar 328 supplied by Staley Starch Company were then added in order to protect the capsules against premature rupture, as mentioned earlier, together with 15 g of a latex binder (620 Latex supplied by Dow Chemical). The resulting mixture was then coated at a coatweight of about 10 $g/m^2$ on to a 49 $g/m^2$ base paper. After drying (at about 105° C. for about 20 seconds), the background reflectance was measured by means of an opacimeter at various parts of the sheet and a mean value obtained. The results, together with that of a control experiment in which no protective agent was used are shown in Table XI below:

TABLE XI

| Protective Agent & Quantity Used (based on wt. of clay) | Background Reflectance (%) Initial | After 10 days |
|---|---|---|
| None (control) | 93.2 | 92.6 |
| Nadavin FP (10%) | 95.0 | 93.9 |
| Glanzol CFD (10%) | 95.1 | 94.1 |
| Kymene 557 (5%)+ + Zonyl RP (0.5%) | 94.7 | 93.3 |
| Polyethylene emulsion (10% polyethylene on a dry basis) | 95.1 | 93.9 |

Each of the protective-treated coated sheets was placed beneath an ordinary sheet of paper which was then written upon. A distinct blue image was produced on the coated sheet in every case.

EXAMPLE XII

Example XI was repeated using a range of anionic surfactants, as protective agents. For comparative purposes Nadavin FP and Glanzol CFD were also repeated, and a control experiment in which no protective agent was used was also carried out. The results are shown in Table XII below:

TABLE XII

| Protective Agent & Quantity Used (based on wt. of clay) | Background Reflectance (%) Initial | After 10 days |
|---|---|---|
| None (control) | 93.3 | 92.1 |
| Nadavin FP (10%) | 95.3 | 94.5 |
| Glanzol CFD (10%) | 95.0 | 94.5 |
| Sodium salt of dodecyl benzene sulphonic acid (10%) | 95.1 | 94.4 |
| EDTA (10%) | 95.9 | 94.3 |
| Manoxol 1B (10%) | 95.9 | 95.3 |
| Manoxol 1T (10%) | 95.1 | 94.5 |
| Sodium lauryl sulphate (10%) | 95.3 | 94.7 |
| Triton GR5 (10%) | 96.3 | 95.9 |
| Nopcote C104 (10%) | 94.7 | 94.1 |

Each of the protective-treated coated sheets was placed beneath an ordinary sheet of paper which was then written upon. A distinct blue image was produced on the coated sheet in every case.

EXAMPLE XIII 22.5 g of Silton M-AB and 7.5 g of Dinkie 'A' china clay were dispersed in water and protective agent was added. The pH was adjusted slowly to 10 with sodium hydroxide solution. 65 ml of an approximately 30% solids content microcapsule suspension (prepared as described in Example XI) were then added. 22.5 g Keestar 328 wheatstarch granules and 15 g of Dow 620 latex binder were also added. The resulting mixture was then coated at a coatweight of about 10 g/m$^2$ on to a 49 g/m$^2$ base paper. After drying, the background reflectance was measured at various parts of the sheet by means of an opacimeter as described previously, and a mean value obtained. The results, together with that of a control experiment in which no protective agent was used are shown in Table XIII below:

TABLE XIII

| Protective Agent & Quantity Used (based on wt. of clay) | Background Reflectance (%) Initial | After 10 days |
|---|---|---|
| None (control) | 95.2 | 94.3 |
| Nadavin FP (10%) | 96.3 | 95.8 |
| Nadavin LT (10%) | 95.9 | 94.9 |

TABLE XIII-continued

| Protective Agent & Quantity Used (based on wt. of clay) | Background Reflectance (%) Initial | After 10 days |
|---|---|---|
| Kymene 709 (10%) | 95.9 | 95.2 |
| Kymene 557 (15%) | 95.9 | 95.2 |
| Kymene 557 (5%) + Zonyl RP (0.5%) | 95.7 | 94.9 |
| Glanzol CFD (10%) | 96.1 | 95.3 |
| Kymene 557 (3%) + Glanzol CFD (3%) + Zonyl RP (0.3%) | 95.9 | 95.4 |
| Nopcobond SWS 10 (10%) | 95.8 | 95.2 |

Each of the protective-treated coated sheets was placed beneath an ordinary sheet of paper which was then written upon. A distinct blue image was produced on the coated sheet in every case.

EXAMPLE XIV

In this Example, the capsules used were prepared as described in German Offenlegungsschrift No. 2 529 427.

22.5 g of Silton M-AB clay, 7.5 g Dinkie 'A,' protective agent and 40 g water were mixed, and the pH of the mixture was adjusted to 10 with sodium hydroxide solution. 50 g of approximately 40% solids content capsule suspension were then added, followed by 22.5 g Keestar 328 wheatstarch and 15 g Dow 620 latex. The mixture was coated on to 49 g/m$^2$ base paper at about 10 g/m$^2$ coatweight, and dried at 105° C. for about 20 seconds. The results are shown in Table XIV below, together with that for a control experiment in which no protective agent was used.

TABLE XIV

| Protective Agent & Quantity Used (based on wt. of clay) | Background Reflectance (%) Initial | After 10 Days |
|---|---|---|
| None | 76.4 | 64.3 |
| Nadavin FP (10%) | 90.0 | 85.9 |
| Polymin P (10%) | 84.8 | 81.8 |
| Zonyl RP (10%) | 85.7 | 79.5 |
| Glanzol CFD (10%) | 85.7 | 79.9 |
| Sodium lauryl sulphate (10%) | 87.0 | 72.3 |
| Teepol 610 (10%) | 86.4 | 78.0 |
| Teepol GD53 (10%) | 85.8 | 73.0 |

Teepol 610 is an anionic surfactant supplied by Shell, and is a sodium salt of a secondary alkyl sulphate. Teepol GD 53 is also an anionic surfactant sold by Shell, and is a mixture of sodium alkyl benzene sulphonate, sodium alcohol ethoxysulphate and a non-ionic alcohol ethoxylate.

Each of the protective-treated coated sheets was placed beneath an ordinary sheet of paper which was then written upon. A distinct blue image was produced on the coated sheet in every case.

EXAMPLE XV

The procedure of Example XIV was followed except that 65 ml of capsules prepared as described in Example XI were used instead of the capsule suspension used in Example XIV. The results are shown in Table XV below:

TABLE XV

| Protective Agent & Quantity Used (based on wt. of clay) | Backgound Reflectance (%) Initial | After 10 Days |
|---|---|---|
| None (control) | 94.9 | 94.3 |

TABLE XV-continued

| Protective Agent & Quantity Used (based on wt. of clay) | Backgound Reflectance (%) Initial | After 10 Days |
|---|---|---|
| Nadavin FP (10%) | 95.4 | 95.0 |
| Glanzol CFD (10%) | 96.1 | 95.6 |
| Teepol 610 (10%) | 96.2 | 95.5 |
| Tergitol 7 (10%) | 96.5 | 95.8 |

Tergitol 7 is an anionic surfactant supplied by BDH Chemicals Limited and is a sodium salt of a secondary alkyl sulphate containing 17 carbon atoms.

Each of the protective-treated coated sheets was placed beneath an ordinary sheet of paper which was then written upon. A distinct blue image was produced on the coated sheet in every case.

EXAMPLE XVI

This Example illustrates production of the present paper using a full size blade coater. The capsules used were prepared generally as described in Example XI, but the quantities used were scaled up and the mixture was maintained at 55° C. overnight after chilling at 15° C.

22.5 kg of Nadavin FP and 296 liters of water were put into a blunger and 225 kg Silton M-AB were dispersed in the mixture. The pH was then raised to 8 by the addition of 13.7 g of 47% sodium hydroxide solution. 500 kg (139 kg dry weight) of capsule suspension were then added. 225 kg of Keestar 328 wheatstarch and 75 kg Dinkie 'A' clay were then dispersed in the mixture, followed by 150 kg Dow 620 latex binder (75 kg dry weight). The mixture was then coated on to 47 g/m$^2$ base paper at a coatweight of about 14 g/m$^2$. The background reflectance of the coated sheet was 96.1% immediately after coating, 96.0% after 10 days, and 94.5% after 7 months.

When an ordinary sheet of paper was placed over the coated sheet and written upon with ordinary writing pressure a distinct blue image was produced on the coated sheet.

EXAMPLE XVII

This Example illustrates the use of the present method with transfer type capsules instead of self-contained type capsules. As stated previously, the use of such capsules does not generally result in an acceptably light sheet. However, the results do illustrate that the present method affords an increased resistance to premature colour development whatever the capsule wall thickness used.

The capsules used in this Example were produced generally as described in Example I of British Pat. No. 1 053 935, except that carboxymethyl cellulose was used instead of gum arabic. The capsule suspension was divided into three batches, (a), (b) and (c).

Batch (a)

The capsule suspension was treated with a 13% solution of BC 71 melamine formaldehyde precondensate as protective agent at 60° C. for ½ hour and then allowed to cool.

40 g of Silton M-AB clay were dispersed in sufficient water to make a 40% solids content mix, and the pH was adjusted to 10 with sodium silicate.

100 ml capsule suspension were then added with stirring, and the resulting composition was then coated onto a paper sheet. A dark blue sheet was obtained, having a reflectance of 19%.

Batch (b)

The capsule suspension was treated as described for batch (a).

40 g Silton M-AB clay were dispersed in sufficient water to make a 40% solids content mix. 4 g of BC 71 melamine formaldehyde precondensate as protective agent were added and the mixture was heated to boiling point, and then allowed to cool. The pH was then adjusted to 10 with sodium silicate.

100 ml capsule suspension were then added with stirring, and the resulting composition was then coated onto a paper sheet in the same manner as described above. The sheet was again blue, with a reflectance of 30%, which is considerably higher than the 19% recorded in the absence of clay pretreatment.

Batch (c)

The capsule suspension in this case was not pretreated.

4 g Nadavin FP resin as protective agent were dissolved in 60 g water. 40 g of Silton M-AB clay were dispersed in this solution to make an approximately 40% solids content mix. The pH was adjusted with stirring over a period of several minutes with sodium hydroxide solution.

100 ml capsule suspension were then added with stirring, and the resulting composition was coated onto a paper sheet in the same manner as described above. The sheet was again blue, with a reflectance of 39%, which again is considerably higher than the 19% recorded in the absence of clay pretreatment.

What we claim is:

1. A method of preparing pressure-sensitive copying material comprising the steps of:

(a) forming a coating composition comprised of (i) microcapsules containing a solution of a colourless colour former, (ii) particulate mineral colour developing material which has been chemically treated with a protective agent in an amount which is less than about 10% based on the weight of the particulate mineral colour developing material and which is effective in inhibiting premature colour development, said protective agent being characterized by being compatible with said microcapsules and by being substantially non-interferring with the colour developing properties of the colour developing material, and, (iii) binder; and (b) applying said coating composition to a substrate.

2. The method of claim 1 wherein said protective agent is polyethylene imine resin.

3. The method of claim 1 wherein said protective agent is a flourine-containing paper sizing agent.

4. The method of claim 1 wherein said protective agent is an anionic surfactant having a group selected from the group consisting of sulphate groups and sulphonate groups.

5. The method of claim 4 wherein said anionic surfactant is selected from the group consisting of a sulphonated ricinoleic acid derivative, a lauryl sulphate salt, a dodecyl benzene sulphonate salt, a dibutyl ester of sulphosuccinic acid and a dioctyl ester of sulphosuccinic acid.

6. The method of claim 1 wherein said protective agent is a self-crosslinkable polymer.

7. The method of claim 6 wherein the coating composition is blade coated onto said substrate.

8. The method of claim 6 wherein the coated substrate has a dry coatweight in the range of from 10 to 15 $g/m^2$.

9. The method of claim 6 wherein said self-crosslinkable polymer is an aminoplast polymer.

10. The method of claim 9 wherein said aminoplast polymer is derived from one member of the group consisting of (1) melamine and formaldehyde, and (2) urea and formaldehyde.

11. The method of claim 6 wherein the binder comprises hydrolyzed polyvinyl alcohol.

12. The method of claim 11 wherein dispersant and stilt material are added to the coating composition.

13. The method of claim 6 wherein the self-crosslinkable polymer is an epichlorohydrin polymer.

14. The method of claim 13 wherein the epichlorohydrin polymer is selected from the group consisting of an aminoepichlorohydrin polymer and an amide/aminoepichlorohydrin copolymer.

15. A method of preparing pressure-sensitive copying material comprising the steps of:

(a) forming a coating composition comprised of
  (i) microcapsules containing a solution of a colourless colour former, said microcapsules having been chemically treated with a first protective agent,
  (ii) particulate mineral colour developing material which has been chemically treated with a second protective agent, and
  (iii) binder; and (b) applying said coating composition to a substrate, wherein said first and second protective agents are added in an amount which is less than about 10% based on the total of the weight of the particulate mineral colour developing material and the dry weight of the microcapsules, said amount being effective in inhibiting premature colour development, said first and second protective agents being characterized by being compatible with said microcapsules and by being substantially non-interferring with the colour developing properties of the colour developing material.

16. The method of claim 15 wherein the first and second protective agents are a polyethylene imine resin.

17. The method of claim 15 wherein the first and second protective agents are a flourine-containing paper sizing agent.

18. The method of claim 15 wherein the first and second protective agents are an anionic surfactant having a group selected from the group consisting of sulphate groups and sulphonate groups.

19. The method of claim 18 wherein said anionic surfactant is selected from the group consisting of sulphonated ricinoleic acid derivative, a lauryl sulphate salt, a dodecyl benzene sulphonate salt, a dibutyl ester of sulphosuccinic acid and a dioctyl ester of sulphosuccinic acid.

20. The method of claim 15 wherein said first and second protective agents are self-crosslinkable polymers.

21. The method of claim 20 wherein said first and second protective agents are the same self-crosslinkable polymer.

22. The method of claim 21 wherein the self-crosslinkable polymer is an epichlorohydrin polymer.

23. The method of claim 22 wherein the epichlorohydrin polymer is selected from the group consisting of an aminoepichlorohydrin polymer and an amide/aminoepichlorohydrin copolymer.

24. The method of claim 21 wherein said self-crosslinkable polymer is an aminoplast polymer.

25. The method of claim 24 wherein said aminoplast polymer is derived from one member of the group consisting of (1) melamine and formaldehyde, and (2) urea and formaldehyde.

26. The method of claim 24 wherein said binder is hydrolyzed polyvinyl alcohol.

27. The method of claim 24 wherein the coated substrate has a dry coatweight in the range of from 10 to 15 $g/m^2$.

* * * * *